United States Patent [19]

Zebree

[11] 3,939,772

[45] Feb. 24, 1976

[54] BLASTING CAPS INITIATABLE BY THERMAL DETONATION ENERGY OF AN EXPLOSIVE GAS MIXTURE, AND BLASTING SYSTEM

[75] Inventor: David T. Zebree, Kingston, N.Y.

[73] Assignee: Hercules Incorporated, Wilmington, Del.

[22] Filed: Oct. 4, 1974

[21] Appl. No.: 512,267

[52] U.S. Cl. ..... 102/22; 102/29

[51] Int. Cl.[2] ..... F42B 3/10

[58] Field of Search ..... 102/22, 23, 27, 29

[56] References Cited

UNITED STATES PATENTS

| | | | |
|---|---|---|---|
| 1,025,065 | 4/1912 | Ingram | 102/23 |
| 1,185,916 | 6/1916 | Kullberg | 102/29 |
| 3,597,919 | 8/1971 | Lilly | 102/27 |
| 3,885,499 | 5/1975 | Hurley | 102/29 |

*Primary Examiner*—Verlin R. Pendegrass
*Attorney, Agent, or Firm*—S. Grant Stewart

[57] ABSTRACT

A nonelectric blasting cap initiated by thermal detonation energy from an explosive gas mixture, in which the required open space for charging and detonating the explosive gas mixture is contained, together with the conduit means, in an end closure member; and the open space is shaped to provide a shell to end closure crimp without impairing flow of explosive gas through the conduits.

A blasting system including a plurality of the above blasting caps is also provided.

10 Claims, 7 Drawing Figures

BLASTING CAPS INITIATABLE BY THERMAL DETONATION ENERGY OF AN EXPLOSIVE GAS MIXTURE, AND BLASTING SYSTEM

This invention relates to nonelectric blasting caps initiated by explosive energy from detonation of an explosive gas mixture. In one aspect, this invention relates to such blasting caps formed from a metal shell and including shell closure means containing an open space and associated conduits for emplacment and detonation of the explosive gas in the cap, and crimp sealed with the metal shell without interference of the crimp(s) with flow of the explosive gas through the conduits.

Nonelectric blasting caps initiatable by explosive energy from the detonation of an explosive gas mixture are disclosed and claimed in the copending application of Hurley, Ser. No. 426,979, filed Dec. 20, 1973, and now U.S. Pat. No. 3,885,499. These blasting caps contain an open space adjacent the initiator charge, and a first conduit extending from outside the blasting cap into the open space in open communication with the initiator charge so as to convey the explosive gas as a confined stream into the open space for responsive ignition of the initiator charge; and a second conduit extending from the open space to the outside of the shell so that a stream of the explosive gas mixture can be continuously passed from the first conduit through the open space and through the second conduit to purge the system for the detonation and responsive ignition of the initiator charge.

In the embodiments illustrated in the above copending application, the cap shell is elongated and closed, including at one end a plug type closure member spaced from the initiator charge to form the requisite open space. Both conduits are plastic and thin walled for flexibility purposes. The first conduit extends into the shell through the end closure member and the second conduit extends from the open space either through the plug end closure or through the side of the cap shell.

Due to the conduit capacity required for the flow of the explosive gas into and from the open space in the cap assembly, and hence the size of the conduits, the available wall thickness of the plug closure portion encompassing the conduits extending therethrough is limited to the extent that often the plug wall cannot sustain the conventional crimp type shell to plug to conduit closure and the result in those instances is undue ingress of the crimp into the conduit passageways with constriction impairing requisite gas flow therethrough.

This invention is concerned with nonelectric blasting cap assemblies of the type above described in which both conduits are flexible, generally plastic, and hence thin walled, and extend within the closure member; and the closure member contains, and is correlated with, the requisite open space to provide for crimp support of the closure member in the shell without impairment of flow of explosive gas through the conduits.

In accordance with the invention, a nonelectric blasting cap is provided which comprises, a closed shell including an elongated closure member therefor deformable for crimping described hereinafter, and an initiator charge within said shell ignitable in response to action of thermal detonation energy of an explosive gas mixture;

said closure member containing an open space substantially coaxial therewith including a cavity disposed intermediate its ends and a perforation extending from the cavity through one end of the closure into open communication with the initiator charge;

first and second conduits each formed from a flexible material extending within said closure member from the opposite end thereof in open communication with the outside of said shell and with said cavity, and in water tight relationship with said closure;

an explosive charge within said shell operatively detonatable in response to ignition of said initiator charge; and crimp means on the exterior of said shell extending through the shell wall around said perforation and then into said end closure member in support of said closure member and said shell in water tight relationship.

In one embodiment, the closure member is superposed on the initiator charge, thus lending support to the initiator charge in operative position in the shell. In another embodiment, particularly in which the initiator charge is self-supporting, the closure plug is spaced apart from the initiator charge thus providing a purge space supplementary to that contained within the closure member.

In preferred practice, the blasting cap shell is metallic and elongated and the end closure member and the first and second conduits within same are each formed from a plastic material such as polyethylene, polypropylene and the like.

The invention is illustrated with reference to the drawings of which

Figure 1:
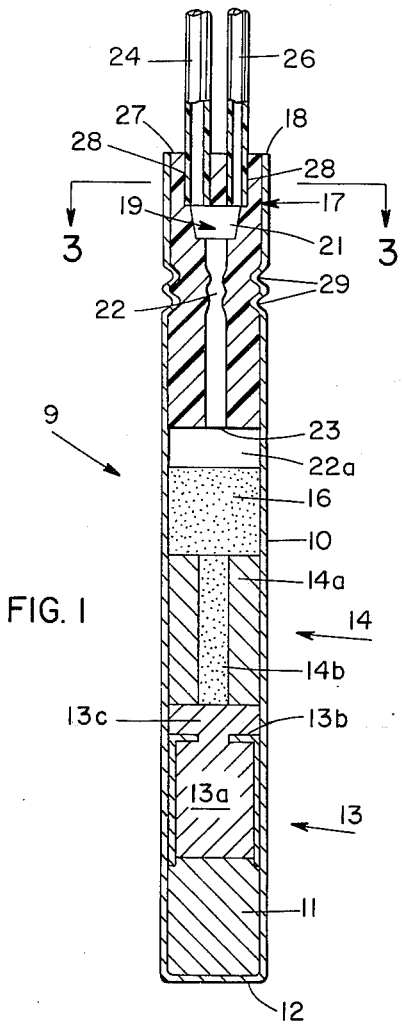
FIG. 1 is a cross-sectional view of a cap assembly of the invention in which the closure member is spaced from the initiator charge.
Figure 2:
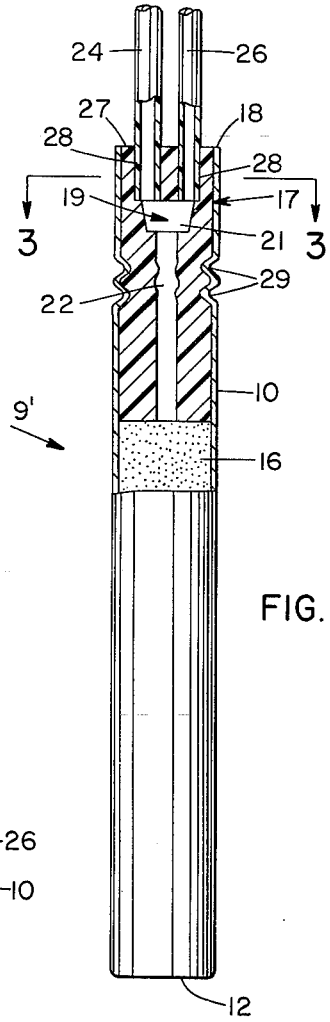
FIG. 2 is the same as FIG. 1 except that the closure member is superposed on the initiator charge.
Figure 6:
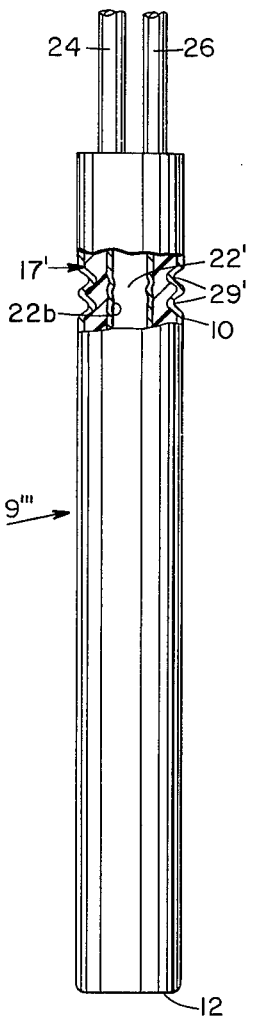

and FIG. 6 is a sectional view of an additional embodiment differing from those of FIGS. 1 and 2 with reference to perforation structure.

In the drawings, like parts are designated by like numbers, and corresponding parts are designated by the same, but primed, numbers.

Referring to FIG. 1, closed elongated metal shell 10 of blasting cap assembly 9 contains base explosive charge 11 in closed end 12, primer assembly 13 superposed on base charge 11, delay assembly 14 superposed on primer assembly 13, and initiator charge 16 superposed on delay assembly 14.

Primer assembly 13 is a diazodinitrophenol charge including the lower density charge 13a contained in capsule **13*b* with the higher density charge 13*c* superposed on capsule 13*b*. Delay assembly 14 is preferably a metal tube 14*a* with a delay charge disposed as core 14*b*. Ignition charge 16 is any suitable charge ignitable by thermal detonation energy from detonation of an explosive gas mixture described hereinafter. Often a supplemental, or wafer ignition charge is disposed intermediate charge 16 and delay 14*b*** to provide a hotter ignition in those instances in which such is required, often with longer burning delay charges. Base charge 11 is detonatable in response to detonation of primer charge 13*a* which in turn is detonatable in response to burning of charge 13*c;* and charge 13*c* is ignitable in response to burning of delay charge 14*b* which in turn is ignitable in response to burning of initiator charge 16.

Figure 5:
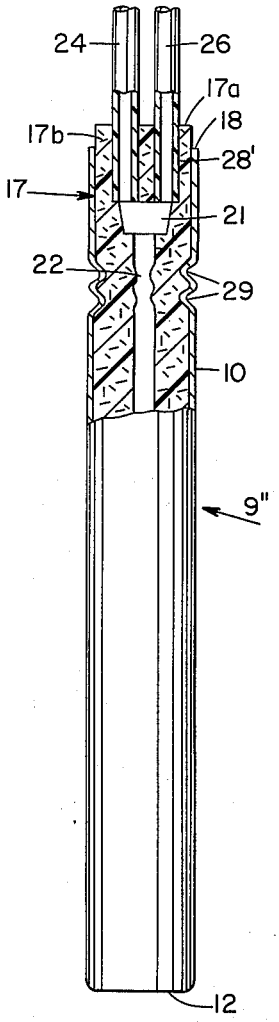
FIGS. 5 and 5A show a now preferred means for sealing the conduits in water tight relationship with the end closure member.
Figure 5A:
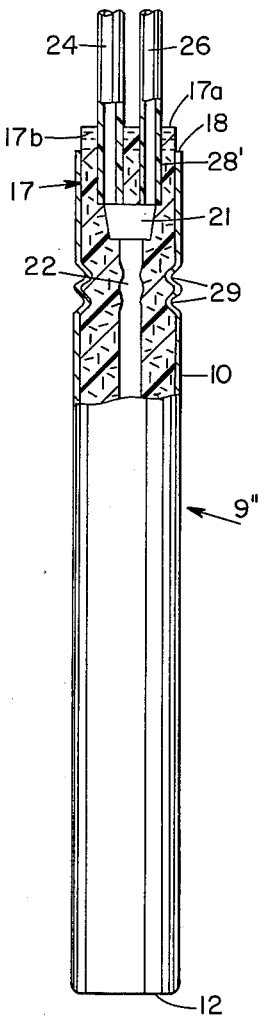

Flexible plastic conduits 24 and 26 are sealed with closure member 17 at each conduit/closure member interface 28 in water tight relationship therewith in any suitable manner such as by an adhesive of the epoxy resin type, fusion, or the like. A now preferred conduit-closure member seal, as illustrated with reference to FIGS. 5 and 5A, is provided by the emplacement of metal powder particles in a top portion of the plastic plug member for induction heating that plug portion and transferring the heat generated by the induction heating to the adjacent plastic conduit surfaces for fusion of the two surfaces at the conduit-closure plug interface followed by cooling with formation of the resulting water tight fusion seal. The conduits 24 and 26, and closure 17 are advantageously formed from the same plastic material, often polyethylene. In that embodiment, a top end portion of closure 17 containing dispersed iron, or other suitable, metal particles 17*b*, extends above top end 18 of shell 10 so that the induction of magnetic energy to the closure conduits interface for the seal will not be impaired by a shielding effect of the metal shell, see FIG. 5. By induction heating the unshielded end closure portion 17*a*, the metal particles 17*b* are then magnetized and hence reoriented, see FIG. 5A, and the heat resulting from that reorientation is transferred to the interface of the conduits 24, 26 and closure 17 for fusion of the interface surfaces to provide the requisite water tight seal between closure 17 and the conduits 24 and 26.

It is of course required that the plastic closure 17 be disposed in water tight relationship with shell 10. Heretofore, to emplace the conventional crimp closure around the shell and into the closure plug, it was necessary that the crimp encompass the flexible plastic conduits 24 and 26; and that practice has often been unsatisfactory in view of the limited wall thickness of the closure wall leading to undue ingress of the crimp into the conduits with excessive constriction of gas flow therethrough.

The invention, in the incorporation of the open space 19 into the closure member in lieu of disposing the open space intermediate the closure member and the initiator charge, and disposing the perforation 22 as part of open space 19, provides sufficient wall thickness of the closure plug, i.e., encompassing the perforation 22, for sustaining a water tight crimp between shell 10 and closure 17 without undue ingress of the crimp into the perforation, thus precluding unsatisfactory flow of the explosive gas through the conduits 24 and 26 and open space 19. Hence, closure member 17 is crimp closed in water-tight relationship with shell 10 by crimps 29 on the exterior of shell 10 encompassing perforation 22 and extending into closure member 17 into supporting water tight relationship therewith, i.e., along a locus of points intermediate the cavity portion 21 and the bottom end 23 of perforation 22.

The blasting assembly of FIG. 2 is the same as that of FIG. 1 except that closure member 17 is superposed directly onto initiator charge 16 thus imparting peripheral support to the initiator 16 for maintaining it in operative position.

Figure 3:
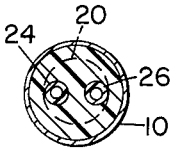
FIG. 3 is a sectional view of the embodiments of FIGS. 1 and 2 taken along the line 3—3.

Generally, the coaxial length of the cavity 21 is less than its maximum linear cross section, the coaxial length of perforation 22 is greater than its maximum linear cross section, and the maximum linear cross section of perforation 22 is less than the maximum linear cross section of cavity 21; each said cross section being measured on a line normal to the longitudinal axis of the closure plug. In preferred practice, the cavity 21 and perforation 22 are of circular cross section, and perforation 22 is cylindrical. However, cavity 21 and perforation 22 can be of any suitable length, width or shape so long as the crimp 29 can be applied as required. Thus in the embodiments of FIGS. 1 and 2, it is required that the maximum linear cross section of perforation 22 be less than that of the central portion 20 of closure plug 17 (see FIG. 3) immediately encompassing conduits 24 and 26 within plug 17 adjacent top end 18 thereof, in order that there is provided sufficient wall thickness of end closure member 17 for the crimp(s) 29. However, as illustrated with reference to FIG. 6, a suitable reinforcing sleeve 22b can be coaxially disposed within perforation 22 in peripheral contact with the inner wall thereof, to reinforceably support perforation 22 against a predetermined undue constriction by a crimp 29′, thus permitting any suitable, and larger, cross sectional dimension of perforation 22 concomitantly with wall thickness of closure 17 for the crimp regulated only by the reinforcement provided by the sleeve member 22*b*.

Although a single blasting cap assembly of the invention can be fired as an initiator of a main explosive charge, a plurality of blasting cap assemblies of the invention are more often utilized in a blasting system as illustrated with reference to FIG. 4, and as disclosed in the copending application of Hurley above referred to. Thus referring to FIG. 4, each of the separate bore holes 31, in earth formation 30, is loaded with any suitable cap-insensitive main explosive charge 32 such as an aqueous gel-type explosive, a dynamite, prills/fuel oil, or the like. A pair of suitable boosters 33 is embedded in each of the main explosive masses. Each booster is capsensitive and is in detonating relationship with the main explosive charge adjacent thereto, and is initiated by action of a blasting cap system of the invention such as that of FIGS. 1, 2 or 6.

Thus, in each bore hole 31, two booster units 33, e.g., each comprising about 500 grams of PETN, tetryl or the like, are embedded, and spaced apart, in explosive mass 32 to provide for detonation of the main explosive charge along its entire length. Each booster unit 33 contains a blasting cap 9, 9′ or 9″ of FIG. 1, 2 or 6. The explosive gas mixture from a source not shown is supplied via line 34 and passed in series through the entire plurality of blasting caps in separate booster charges in the three bore holes via conduits 24 and 26 of each blasting cap. The flow of explosive gas mixture from line 34 in series through the entire plurality of blasting caps in the bore holes is continued until each open space 19 (cavity 21 plus perforation 22 or 22′) or 19 plus 22*a*, is substantially free from initially present gas, after which the flow of the explosive gas mixture is terminated or continued as desired, followed by detonation of the gas upstream from the first of the bore holes 31 and travel of the detonation wave front in series through each of the blasting caps in ignition relationship with the initiator charge therein. Dependent on whether the main charge is reliably cap-sensitive, a booster charge(s) may not be required, in which event one or more of the blasting caps are embedded directly in the main charge.

Figure 4:
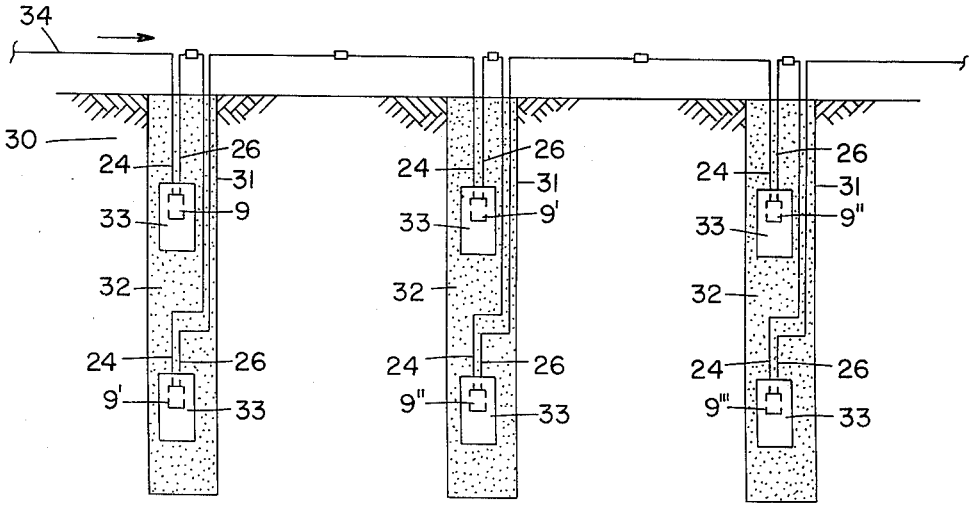
FIG. 4 illustrates a blasting system including a plurality of blasting caps of the invention.

The system of FIG. 4, containing delay caps, regulates the burning time of each delay fuse and hence the delay between shots in each bore hole including when desired, a progressively longer delay time along the entire series of boosters in the bore holes.

In assembling a blasting cap of the invention, as illustrated with reference to FIGS. 1 and 2, the base, primer, delay (if required) and initiator charges are in that order pressed into emplacement in a cap shell 10 through an open end 18 thereof. Closure member 17 containing passageways for receiving conduits 24 and 26 in position and containing conduits 24 and 26 emplaced therein is then inserted friction tight into closing relationship with shell 10 in the open end thereof, either spaced from the initiator charge or seated on the initiator charge, as required.

Conduits 24 and 26 when inserted into the passageways are secured therein in water tight relationship with the closure member at the closure-conduit interface as described above. One or more crimps 29 are then applied to the exterior of shell 10 for ingress into closure 17 or 17' intermediate cavity 21 and bottom end 23 of perforation 22 and 22' to effect the requisite water tight seal.

By way of further illustration, blasting cap assemblies of the embodiment of FIG. 1 formed from a cylindrical metal shell, wherein the end closure plug and the conduits are formed from a solid polyethylene, and the cavity 21 and the perforation 22 are each of circular cross section, often have dimensions within the following ranges.

| | Inches |
|---|---|
| Conduits 24 and 26 | |
| inside diameter | 0.040 – 0.080 |
| outside diameter | 0.060 – 0.120 |
| Shell 10 | |
| length | 1.5 – 4.5 |
| wall thickness | 0.005 – 0.020 |
| inside diameter | 0.20 – 0.30 |
| Plastic Closure Plug 17 | |
| length | 0.5 –1.5 |
| cavity 21 | |
| minimum diameter | |
| top | 0.180 |
| bottom | 0.060 |
| minimum axial length | 0.060 |
| perforation 22 | |
| diameter (uncrimped) | 0.06 – 0.20 |
| length | 0.50 – 1.0 |
| Open space 22a (FIG. 1) | |
| diameter | 0.040 – 0.080 |
| length | 0.03 – 0.25 |
| | Grams |
| Charges | |
| ignition 16 | 0.20 – 0.80 |
| delay 14b | 0.20 – 2.0 |
| primer 13 | 0.20 – 0.30 |
| (13c: 13a, about 1:4) | |
| base charge 11 | 0.20 – 1.00 |

Although the plug closure member is preferably formed from a suitable solid plastic such as polyethylene, polypropylene, Nylon, polyvinyl chloride, and the like, it can be formed from other materials such as cork, lead, rubber or the like. Similarly, conduits 24 and 26 which can be formed from any suitable flexible material are more often formed from polyethylene or polypropylene often having a wall thickness from about 0.02 to 0.04 inches.

Further exemplary of charges utilized in the cap assemblies of the invention are ignition charges 16 such as lead/selenium, often with suitable additives such as Snow Floss, lead oxide/boron, lead oxide/manganese boride, and the like; primer charges such as diazodinitrophenol charges **13*a* and 13*b*, and lead azide; and base charges 11** such as PETN, tetryl and the like.

As will be evident to those skilled in the art, various modifications can be made or followed in light of the foregoing disclosure and the discussion without departing from the spirit or scope of the disclosure or from the scope of the claims.

What I claim and desire to protect by Letters Patent is:

1. A nonelectric blasting cap assembly, which comprises, a closed shell including an elongated closure member therefor, deformable for crimping described hereinafter, and an initiator charge within said shell ignitable in response to action of thermal detonation energy of an explosive gas mixture;

said closure member containing an open space substantially coaxial therewith including a cavity disposed intermediate its ends and a perforation extending from said cavity through one end of said closure into open communication with said initiator charge;

first and second conduits each extending within said closure member from the opposite end thereof in open communication with the outside of said shell and with said cavity, and in water tight relationship with said closure;

an explosive charge within said shell detonatable in operative response to ignition of said initiator charge; and crimp means on the exterior of said shell extending through the shell wall around said perforation and then into said end closure member in support of said closure member and said shell in water tight relationship.

2. A blasting cap assembly of claim 1 wherein said shell is metallic and elongated, and said end closure member and said first and second conduits, are each formed from a plastic material.

3. A nonelectric blasting cap assembly of claim 2 wherein said closure member is spaced from said initiator charge to thereby provide an open space supplemental to said open space in said closure member.

4. A nonelectric blasting cap assembly of claim 2 wherein said closure member is superposed on said initiator charge to thereby provide peripheral support for said initiator charge in its operative position in said shell.

5. A blasting cap assembly of claim 2 wherein the coaxial length of said cavity is less than the maximum linear cross section thereof, the coaxial length of said perforation is greater than the maximum linear cross section thereof, said maximum linear cross section of said perforation is less than said maximum linear cross section of said cavity, and each said linear cross section measured on a line normal to the longitudinal axis of said end closure.

6. A blasting cap assembly of claim 5 wherein said shell, said end closure, said cavity and said perforation are each of circular cross section.

7. In a blasting cap assembly of claim 2, a reinforcing sleeve member coaxially within said perforation in contact along its outer surface with the end closure wall surface forming said perforation to support said perforation against a predetermined undue constriction by said crimp means.

8. In a blasting cap assembly of claim 2, a primer charge in said shell intermediate said explosive charge and said initiator charge and detonatable in operative response to ignition of said initiator charge, and disposed in that detonating relationship; and said explosive charge detonatable in response to detonation of said primer charge and disposed in that detonating relationship.

9. In a blasting cap assembly of claim 8, a delay charge intermediate said primer charge and said ignition charge, and ignitable in response to burning of said ignition charge, and said primer charge detonatable in operative response to burning of said delay charge.

10. A blasting system including a plurality of blasting cap assemblies of claim 2, wherein said first conduit of the first of said plurality is connected with a source of an explosive gas mixture, and said second conduit of the first of said plurality is connected with said first conduit of the second of said plurality and thereby in series to provide for purging action of said open space in each said blasting cap by flow of the explosive gas mixture in series flow therethrough and subsequently for detonation of said explosive gas mixture to propagate a detonation front in series through each of said caps in said plurality.

* * * * *